United States Patent [19]

Lefebvre

[11] 4,234,785

[45] Nov. 18, 1980

[54] LIQUID LEVEL RESPONSIVE CONTROL DEVICE

[76] Inventor: Fredrick L. Lefebvre, 700 Solano Prado, Coral Gables, Fla. 33156

[21] Appl. No.: 7,154

[22] Filed: Jan. 26, 1979

[51] Int. Cl.[3] ..... H05B 3/06

[52] U.S. Cl. ..... 219/523; 219/318; 219/324; 219/331; 219/333; 219/337; 219/354; 219/494; 219/541; 119/5; 250/354

[58] Field of Search ..... 219/216, 218, 326, 331, 219/324, 328, 333, 334, 335, 354, 336, 337, 437, 489, 494, 512, 517, 523, 541, 544, 553; 119/5; 337/120, 315; 200/84 R

[56] References Cited

U.S. PATENT DOCUMENTS

| | | | |
|---|---|---|---|
| 3,134,008 | 5/1964 | Finn | 219/523 |
| 3,576,426 | 4/1971 | Sesholtz | 219/523 |
| 3,619,565 | 11/1971 | D'Elia | 219/523 |
| 3,746,836 | 7/1971 | Summerfield et al. | 219/328 |
| 3,983,361 | 9/1976 | Wild et al. | 219/523 X |
| 4,068,116 | 1/1978 | McKinstry | 219/337 X |
| 4,107,514 | 8/1978 | Ellson | 219/523 |

*Primary Examiner*—Volodymyr Y. Mayewsky
*Attorney, Agent, or Firm*—Frank B. Robb

[57] ABSTRACT

There is disclosed liquid level responsive control means for use with heating means for liquid in tanks comprising a control unit, main power supply connections therefore, a source of radiant energy to be immersed in the liquid being heated, sensing instrumentalities closely adjacent said source, said instrumentalities including a recycling bi-metal switch operable at a predetermined temperature produced by the source aforesaid, and a non-recycling or fuse element connected in series with the said switch and operable at a higher temperature, connections from the control unit to supply power to the radiant energy source and connections to the sensing instrumentalities and to the tank heating means.

7 Claims, 5 Drawing Figures

LIQUID LEVEL RESPONSIVE CONTROL DEVICE

BACKGROUND OF THE INVENTION

It has long been necessary and desirable to heat various types of liquids in tanks, as for example liquids used in plating of various kinds as well as in preparing articles for plating and similar processes, the liquids being both acid and alkaline as well as corrosive in many instances.

Inasmuch as such liquids may destroy certain heating elements, such elements must be of composition to resist that action. In acid conditions quartz tube immersion heaters generating infra-red radiation are particularly suitable and well known.

In alkaline conditions, metal tubular heaters for generating radiation are frequently used, though they would be damaged in acid conditions.

In all such instances and environments, the liquid level is necessary to be maintained, as lowering of the level below the upper end of the hot zone of radiating heaters, may result in damage and/or destruction of such heaters, and thus level indicating warning and control systems are particularly desirable.

Such controls have in the past taken the form of float means involving linkages and micro-switches, which are unreliable and adversely affected by the environment.

Other controls known as proximity types have also been used, but these involve delicate parts and circuitry including capacitors which may be initially workable but do not stand up under the conditions to which they are subjected, and are thus affected as to accuracy and reliability.

Thus the instant invention, which embodies an entirely new approach, is particularly suitable since the parts may be of rugged construction and in any event are not subject to many of the problems of prior liquid level responsive control means, being simple in construction and operation with fail safe means to provide maximum effectiveness and instant response.

With the foregoing in mind, the principal and other objects and improvements of this invention will be understood from the description and claims appended hereto and shown in the drawing wherein:

DESCRIPTION OF THE INVENTION

Figure 1:
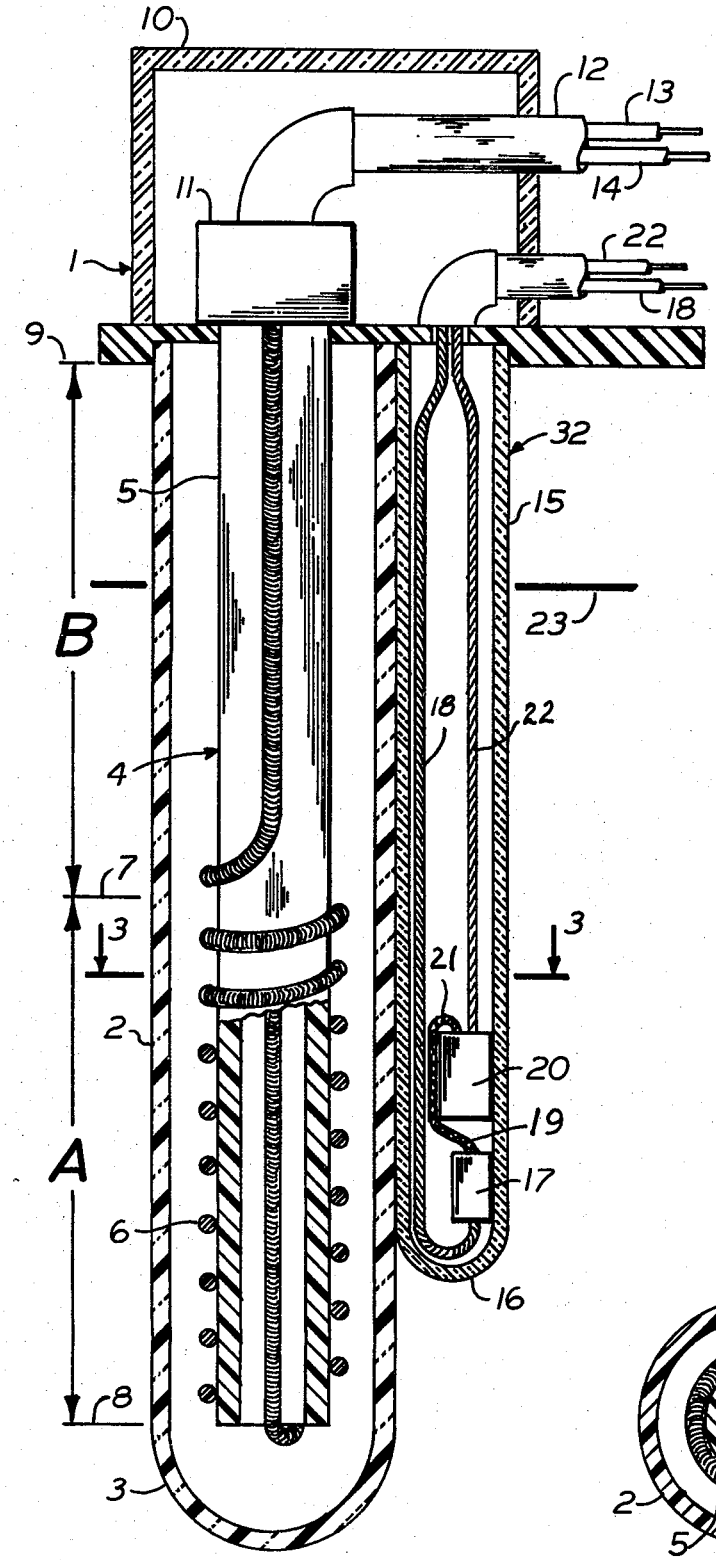
FIG. 1 is a vertical sectional view, partly fragmentary showing one form of heater device used in the control means hereof.

Referring to the drawing, there is disclosed a liquid level responsive control means which embodies basically an immersion heater of the quartz tube type generally denoted 1, which includes a body of quartz 2 having the lower end sealed at 3 and incorporating therewithin the heating means 4 which includes a suitable support 5 of tubular nature around which is positioned a suitable resistance wire of nichrome or the like designated 6 in the form of a coil which is in turn coiled on the member 5 and as such provides a hot zone indicated at A extending from the line 7 to the lower end at 8 and a cold zone B extending from the line 7 upwardly to the line indicated at 9 as a basis for definition.

The heater just described is generally conventional in form and quartz is used for the body 2 because it is transparent to radiation and thus is particularly suitable for use in the conditions to be subsequently setforth.

The heater as usual includes a cover at 10 within which the usual connecting means such as 11 are provided leading to a conductor cable 12 with the conductors 13 and 14 extending outwardly therefrom for connection in a manner to be setforth.

Along side the body 2, in contact therewith and thus having line contact, is a further tube of quartz indicated at 15, likewise sealed at 16 at its lower end, this tube being designated as embodying the sensing instrumentalities hereof.

Figure 2:
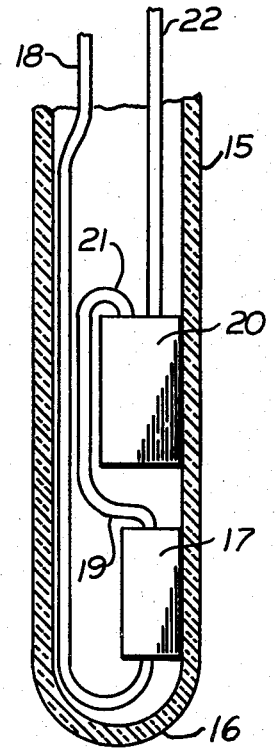
FIG. 2 is an enlarged fragmentary view of the lower end of the sensing instrumentalities.
Figure 3:
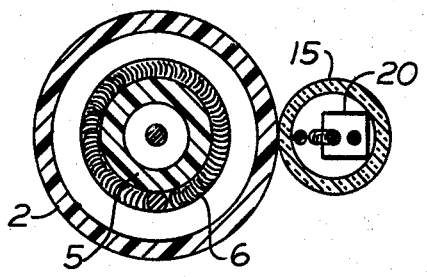
FIG. 3 is a cross-sectional view taken about on the line 3—3 of FIG. 1 looking in the direction of the arrows.

Within the tube 15, there is provided, a non-recycling fuse 17, having the leads 18 and 19 extending therefrom, reference being had at this point to FIG. 2, those leads extending upwardly and being of such a nature that with the insulation thereon a spring-like condition is provided to maintain the fuse 17 in position against the wall of the tube 15.

Above the fuse 17 is a recycling switch such as of bi-metal construction designated 20, which is connected to the fuse 17 so that the fuse 17 is in series therewith from the lead 21 extending from said switch 20 and a further lead 22 is provided extending upwardly and indicated as leading outwardly from the cover 10 in FIG. 1.

It is again noted that with the insulation and spring-like nature of the wires forming the lead, the switch 20 and fuse 17 are maintained in their lower positions at the lower end of the tube 15 being the sensing instrumentalities as heretofore stated.

The sensing instrumentalities just described, are positioned so that the fuse 17 and switch 20, are at the central portion of the hot zone A as noted in FIG. 1, and thus when the radiation is being developed by the heater element 6, the infra-red nature thereof will cause the same to pass through the body 2 being transparent to infra-red radiation at the short wave length end of the spectrum, specifically at wave lengths on the order of 3 to 4 microns and likewise penetrate the tube 15 which is also of quartz and thus transparent to such radiation.

However since in the ordinary use of this particular device, while not intended as a means to provide heat to the solution is primarily directed to controlling the operation of other heaters therein, and thus is normally immersed in the solution to some point such as is suggested at and by the line 23.

It will thus be seen that normally the radiation produced by the element 6, is not direct radiation to the switch 20 and fuse 17 but is absorbed largely by the fluid in which the device just described is immersed and operates therefor as a heater.

It is proposed that the heater in this instance be one of about 1,000 Watts and thus is denominated as a de-rated heater.

In order to control the heater just heretofore described, the control circuitry is enclosed in a box designated diagramatically at 25, and taken with the sensing instrumentalities previously just described, is considered to be the control unit hereof and as such will be described with that in mind.

Within the housing or box 25 a suitable switch 26 is provided, being of the normally open type, which supplied with energy from a 110 Volt line and leads 27 and 28.

The leads or conductors 27 and 28 in turn provide for energizing the switch 26 by means of further leads 29 and 30 through the connection thereof at 31 with the lead 22 of the sensing instrumentalities which will for the sake of this description here be designated as 32, the other lead from the switch 26 being designated 33 and connected to the lead 18 from the sensing instrumentalities 32.

It will thus be understood that when the switch 26 is energized by application of power through the leads 27 and 28 from any suitable source of power, the switch will close and complete the circuit, through the switch 20 and fuse 17, the same time directing power or controlling the power to the tank heaters through the leads 34 and 35, the tank heater being indicated at 36 as a single unit but obviously being arranged so that the heat may be applied to the tank in any preferred form as by a series of immersion heaters all of which are controlled by the tank heater arrangement and thus operable when it is operating.

Assuming that the conditions are as shown in the drawing, it will be seen that with the level of the liquid at 23, the heater 4 and its associated sensing instrumentalities are immersed in the liquid to a point where the normal heating action of the heater is taking place, but if the liquid level drops for any reason whatsoever to a point where the switch 20 is exposed to direct radiation from the heating coil 6, without the surrounding fluid, that direct radiation will cause a 1,000° F. or more immediate increase in temperature effecting a very positive actuation of the switch 20, being bi-metallic for example, so that it will open.

Immediately upon the opening of the switch 20, the circuit through the leads 18 and 22 and thus 31 and 33 into the control housing 25, will interrupt the actuation of the switch 26 permitting the switch to open, and thus completing another circuit therewithin including the contact 35 and a contact 36 therein the switch likewise, which in turn will operate to provide a signal from a signaling source 37 which may include a horn such as indicated at 38 and a light 39 either or both of which may be desirable.

It will be clear that as long as the condition of low level continues, the signal 37 will be actuated, and if the level drops far enough, the direct radiation from the coil 6 will impinge upon the fuse 17, and being non-recyclable, will permanently interrupt the circuit through the entire system.

It should be noted parenthetically that when the switch 26 opened obviously the tank heater and control connected by the leads 34 and 35 was actuated and the heater and control 36 thus operated to interrupt the heating of the tank as well as the operation of the control heater described in detail.

It should be noted that in the event the liquid level does not drop below the area of the switch 20, but in fact is restored to the level 23 for example, without having contacted or permitted direct radiation to contact the fuse 17, the recycling nature of the switch 20 will cause the switch 26 to be actuated again and restore the operation of the tank heater and control as well as the control heater described and indicated in FIG. 1.

The switch 20 is designed to be effective on a large number of recycling actuations and thus observation of the signal will prevent destruction of any article or eliminate the necessity to replace the fuse in the sensing instrumentalities 32.

Figure 5:
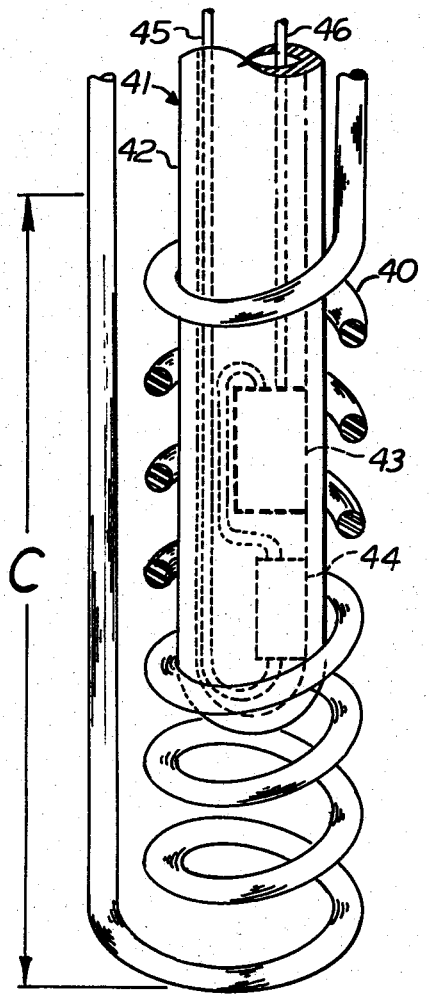
FIG. 5 is a fragmentary view, in elevation, side elevation, showing another form of heater used in this concept.

A modified form of control heater is disclosed in FIG. 5, as embodying tubular metallic heater 40, which in this instance as shown, is arranged in a cylindrical coil, the hot zone being designated C and as indicated also a sensing unit or sensing instrumentalities designated 41 are positioned within the coil to operate in the manner previously described with reference to FIG. 1.

In this instance the sensing instrumentalities are enclosed within a stainless steel tube 42 for example and yet include the recycling switch or bi-metallic switch 43 as well as the fuse 44 connected in series therewith and extending to the leads 45 and 46 comparable to the leads 18 and 22 in the FIG. 1 disclosure.

The lower end of the sensing instrumentalities 41 is positioned so as to be within the central portion of the hot zone C and as such will operate in the same manner as the sensing instrumentalities 32 of FIG. 1.

In this instance however it happens that the sensing instrumentalities in the tube 42 are surrounded by the electric heating element 40 and thus perhaps more instantly affected by direct radiation when the liquid level drops below the upper end of the hot zone and thus direct radiation is effective to operate the switch 43.

Figure 4:
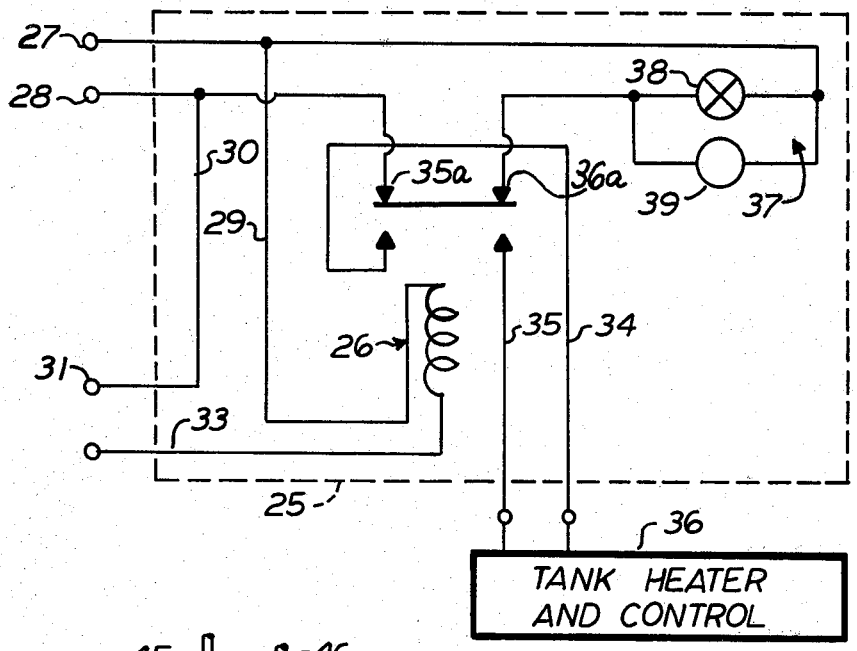
FIG. 4 is a diagramatic view showing the circuitry which is suitable for use herein.

Obviously when the fluid level drops if it does so that direct radiation affects the fuse 44, the termination of the heating of the tank may be effected through this control heater just described in the same manner and through the same circuitry as that of FIG. 4. Under certain conditions it may be advisable that fuse 44 have a higher temperature rating than the switch 43 to prevent fuse actuation at the same time as the switch.

In this instance the tubular heater 40, is made of suitable material which will resist alkaline solutions and is of any well known composition, which may be procured from different manufacturers and formed in the manner described.

There is thus provided basically hereby, a means of directing radiation at control or sensing instrumentalities so that other heating means in a tank solution may be controlled, the basic improvement residing in the fact that positive instantaneous control of the heating devices which are used in the tank is effected by a control heater, which in turn depends upon the impact of direct radiation to sensing instrumentalities and controls tank heaters and other means for heating tanks whether of the immersion type or any other means which are suitably to be controlled by this arrangement.

The forms of heaters here described, while having the characteristics of infra-red radiation generating in the 3 to 4 micron wave length area of the infra-red spectrum, are of relatively small size and thus may be classified as control heaters even though they do have the ability to heat small quantities of solutions.

Water based solutions, being capable of nearly totally absorbing such radiation will be particularly suitable for level control indication since an almost instantaneous response of the levels here described to direct radiation will be effected when the solution level drops to a height which will expose either of the recycling switches 20 or 43 or fuses 17 or 44 to direct radiation without the intervening absorptive action of a solution.

The device described, in the forms illustrated are capable of being positioned with the sensing instrumentalities 32 and 41 at different levels in the solution and thus different size tanks may be used and intended changes in solution depth may be accommodated.

I claim:

1. Liquid level responsive control means for use in connection with the heating of liquid in tanks, comprising a control unit, main power supply connections therefore, a source of radiant energy to be immersed in the liquid being heated and connected to said unit to be energized for radiation generation, sensing instrumentalities closely adjacent said source, said instrumentalities including a recycling switch connected to said unit, said switch being operable to terminate operation of the said source, when the switch is subjected to direct radiation from the source aforesaid when the liquid reaches a predetermined lower level.

2. Control means as claimed in claim 1, wherein a non-recycling fuse element is connected in series with the switch first mentioned, to operate when the liquid level reaches a level below that referred to heretofore, and prevent operation of the radiant energy source until said element is replaced.

3. Control means as claimed in claim 2, wherein the source of radiation comprises a quartz tube heater for generation of infra-red radiation, having a hot zone as its lower end portion, the sensing instrumentalities includes a quartz tube in which the switch is positioned above the fuse at the lower end of said tube, said lower end being positioned at the central portion of the hot zone of said heater, and thereby subject to direct radiation when the liquid level is lowered sufficiently to expose at least a portion of said hot zone.

4. Control means as claimed in claim 2, wherein the source of radiation comprises a quartz tube heater body having infra-red radiation generating means therein and having a hot zone at the lower end thereof, the sensing instrumentalities include a quartz tube extending along and in contact with the heater body, said tube having the recycling switch and fuse element therein at the lower end thereof, said lower end being positioned along the central portion of the hot zone of said heater.

5. Control means as claimed in claim 1, wherein the source of radiation includes a cylindrically coiled metal tubular heater for generating radiation, and comprising the hot zone, at the lower end portion of the heater, the sensing instrumentalities comprise a metal tube sealed at its lower end, said fuse element being positioned below the switch therein, and said lower end is located at the central portion of the hot zone aforesaid and within the coils of the heater, being spaced therefrom, whereby when the liquid level reaches a position below the upper end of the hot zone, the switch is exposed to direct radiation and actuates the control unit as stated.

6. Liquid level responsive control means for use in connection with the heating of liquid in tanks, comprising a control unit, main power supply connections therefore, a source of radiant energy to be immersed in the liquid being heated and connected to said unit to be energized for radiation generation, sensing instrumentalities closely adjacent said source, said instrumentalities including a switch connected to said unit, said switch being operable to actuate a signal, when the switch is subjected to direct radiation from the source aforesaid.

7. Liquid level responsive control means for use in connection with the heating of liquid in tanks, comprising a control unit, main power supply connections therefore, a source of radiant energy to be immersed in the liquid being heated and connected to said unit to be energized for radiation generation, sensing instrumentalities closely adjacent said source, said instrumentalities including a switch connected to said unit, said switch being operable to actuate a signal and terminate operation of the said source when the switch is subjected to direct radiation from the source aforesaid when the liquid reaches a predetermined level.

* * * * *